United States Patent [19]

Harrington

[11] 4,042,247

[45] Aug. 16, 1977

[54] SPIN TOY

[76] Inventor: Robert W. Harrington, 1884 Oakridge Drive, Akron, Ohio 44313

[21] Appl. No.: 661,407

[22] Filed: Feb. 25, 1976

[51] Int. Cl.[2] ..... A63F 5/04

[52] U.S. Cl. ..... 273/141 A; 46/47; 46/236

[58] Field of Search ..... 273/141 R, 141 A, 1 M; 46/47, 241, 1 R, 45, 236, 59

[56] References Cited

U.S. PATENT DOCUMENTS

| | | | |
|---|---|---|---|
| 973,186 | 10/1910 | Fisher | 273/141 R |
| 1,167,407 | 1/1916 | Johnson | 273/141 R |
| 2,423,198 | 7/1947 | McClure, Jr. | 46/47 |
| 2,961,796 | 11/1960 | Davis | 76/236 |
| 3,395,482 | 8/1968 | Sarro | 46/47 |
| 3,425,698 | 2/1969 | Steiert et al. | 273/141 A |
| 3,706,158 | 12/1972 | Jensen | 46/241 X |
| 3,864,872 | 2/1975 | Hoetzel | 46/241 |

FOREIGN PATENT DOCUMENTS

| | | | |
|---|---|---|---|
| 646,214 | 6/1937 | Germany | 273/141 R |

*Primary Examiner*—Richard C. Pinkham
*Assistant Examiner*—Arnold W. Kramer
*Attorney, Agent, or Firm*—Harold S. Meyer

[57] ABSTRACT

A spin toy has a screw threaded post with a magnet near the top to hold an iron spinner on the post by one edge so that it hangs at an angle. A flip of the finger starts the spinner on a constant speed gyratory travel down the post. The spinner can be used as a pointer to indicate by chance any one of several indicia.

4 Claims, 4 Drawing Figures

SPIN TOY

BACKGROUND

Spin toys in which a spinner, once put in motion, continues to spin in a gyratory fashion under the influence of gravity, have been proposed, either for amusement because of an unusual and fascinating behavior, or as a part of a game played by two or more people. Examples of the amusement type are shown in Davis U.S. Pat. No. 2,961,796 and Steiert U.S. Pat. No. 3,217,446. Examples of the game type are shown in Hyde U.S. Pat. No. 1,038,756 involving simple spinning without gyration, and in Steiert et al. U.S. Pat. No. 3,425,698 showing gyratory motion.

SUMMARY OF THE INVENTION

This invention is a spin toy of the special type in which a spinner which is radially balanced, or nearly so, is loosely mounted on a post which preferably has fine pitched helical grooves such as those of an ordinary machine screw. Such a spinner is not easily brought into the desired rapid gyratory motion in which it follows the groove of the screw thread down to the base. An untutored player may find it completely impossible to initiate the desired gyratory motion, and instead will find that the spinner will fall precipitously to the base.

In this invention failure to initiate gyration is almost completely eliminated by a novel construction in which a fixed magnet is installed at the top of the post, and the spinner is made of magnetically attractable material.

This novel construction constrains the spinner for easy placement so that it will be held by the magnet in a tilted position so that it will engage the post at the proper angle for gyratory descent. The player can then start the spin by a gentle flick of the finger against the edge of the spinner, whereupon the spinner will rapidly attain a constant gyratory speed and descend to the base within a few seconds.

THE DRAWINGS

In the accompanying drawings.

DETAILED DESCRIPTION

In this invention a vertical post is mounted on a suitable flat horizontal base of any convenient material such as wood, metal, plastic, sole leather, or the like, which will have numbers in sectors of the circumference if a number game is to be played.

Figure 1:
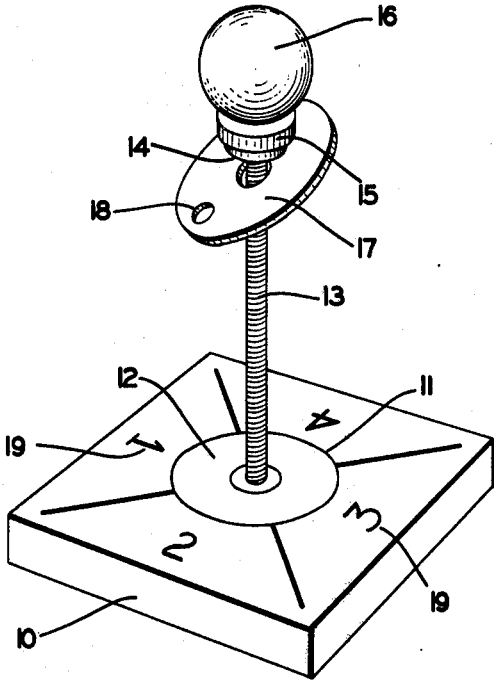
FIG. 1 shows one embodiment of the invention with the spinner at the top of its post ready for play.

Specifically, in FIG. 1 a base 10 of semi-rigid material has a central opening 11 into which is placed an insert 12 of similar material with a friction fit. In this instance, the numbers 1, 2, 3 and 4 appear in sectors of the base 10. In the insert 12 is firmly fastened in a vertical position a helically grooved post 13 which can actually be a common machine screw of approximately ¼-inch diameter and a length of several inches with a normal pitch such that the thread makes several turns in a length corresponding to the diameter. Near the top of post 13 is a small ring 14 of nonmagnetic material, which may be made of polyethylene or other convenient inexpensive plastic material, which is threaded onto the post 13 with a tight fit so as to maintain a fixed position.

Resting on the ring 14 is a small annular magnet 15 which is preferably made with a diameter greater than that of ring 14, and with a central opening of considerably greater diameter than the post 13 so that it will not significantly magnetize the post. The magnet 15 is preferably a nonmetallic magnet, such as a ceramic or plastic magnet consisting of magnetizable iron oxide or other similar material bonded with a ceramic medium or with an organic moldable plastic in a small but sufficient quantity to hold the magnetizable material in a coherent mass. Such magnets are easily magnetized with the magnetic poles in almost any desired configuration, which is often difficult or impossible to do with metallic magnets. In this instance the magnet 15 is preferably magnetized with the top and bottom plane faces being the magnetic poles.

Preferably the top of the post is finished with a knob 16 of any suitable nonmagnetic material such as wood or a molding plastic. The knob is threaded onto the post so as to clamp the magnet 15 between the ring 14 and the knob 16.

Loosely fitting on the post 13 is a disc 17 of iron with a central hole of such diameter as to permit it to rest against the post 13 at an angle of approximately 45°. If the spinner is to be used for indicating numbers or other information, it will be provided with a marking such as an arrow point or, in this case, a simple hole 18 punched through the material.

In play with this spin toy, the spinner 17 is lifted to a position near the top of the post so that it will hang from the magnet 15. If it were not for the nonmagnetic ring 14, the spinner 17 would be attracted into a position flat against the magnet 15 in which it would be at a right angle to the post 13 and therefore horizontal. It is quite difficult to induce gyration of a spinner from such a position exactly perpendicular to the post. However, it is very easy to induce gyration when the spinner is initially in essentially the same angle relation to the post as that which it assumes during its gyratory descent. Accordingly, the ring 14 is thick enough to prevent the magnet 15 from supporting the spinner 17 in a horizontal position but of a diameter enough smaller than that of the magnet 15 so that when the spinner 17 is tilted to its intended operating relationship it will just touch an edge of the magnet 15 and hang in that tilted position until disturbed.

Figure 2:
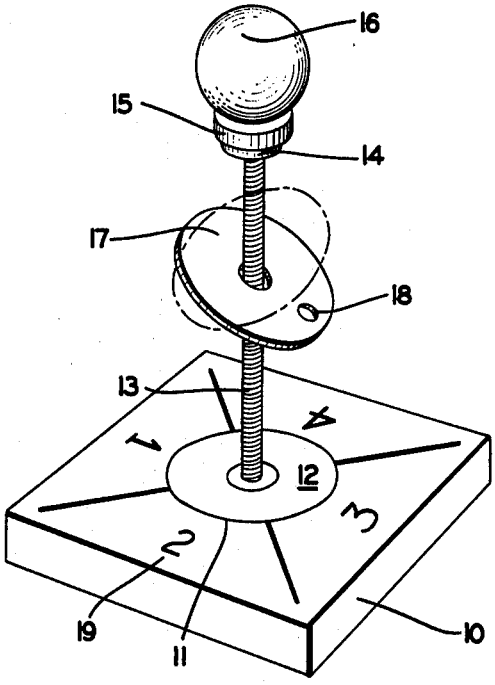
FIG. 2 shows the spinner as it is gyrating part way down the post.
Figure 3:
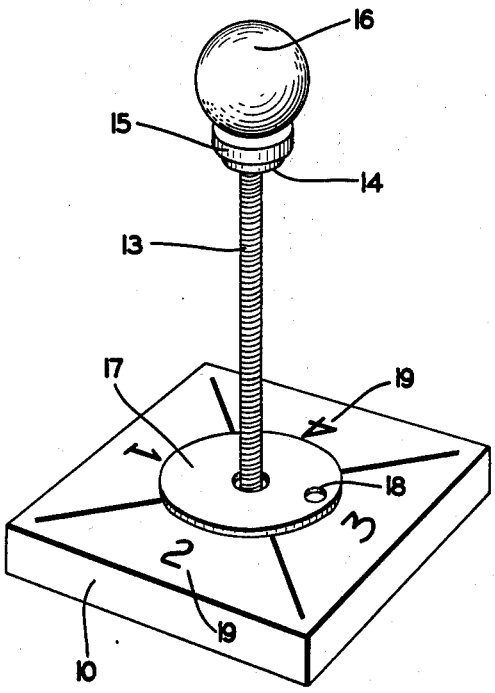
FIG. 3 shows the spinner resting at the bottom of its descent.

To commence gyration, the player will nudge the spinner 17 with a light horizontal flick of the finger in a clockwise direction, that is, the direction of the downward helical path of the screw thread on post 13. Such a motion of the spinner 17 almost invariably breaks the contact with the magnet 15 and commences the gyratory motion down the post. As will be seen in FIG. 2, the spinner as it descends undergoes a complex gyratory and rotational motion following the groove of the screw thread of post 13 at a constant speed until it reaches the bottom and comes to rest against the base 10, as shown in FIG. 3.

The indicator 18 on the spinner 17 then indicates one or another of the numerals 19 on the base 10, which in this case is 3. The indicated number can then be used in the play of whatever particular game or other exercise may be involved in the use of the toy.

Figure 4:
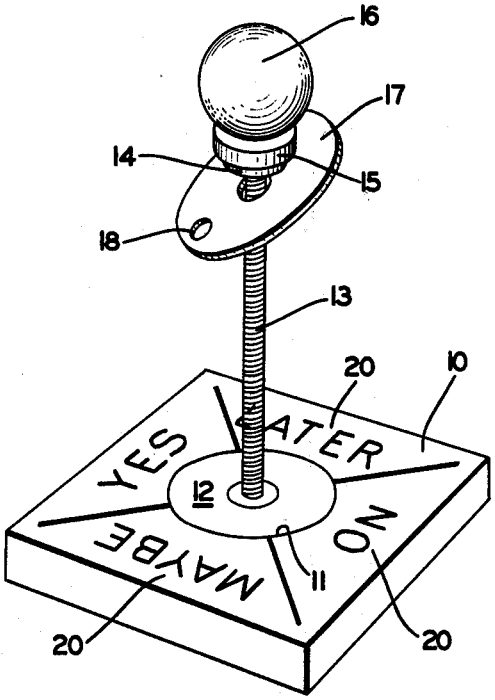
FIG. 4 shows a variation in which legends are present on the base instead of numbers.

The wide variety of uses to which this toy can be put is suggested in FIG. 4. In this instance, the base 10 is reversible so that insert 12 can be snugly fitted into base 10 with either side of the base up. The opposite face of base 10 can have other indicia 20 on it, such as the words of instruction shown in FIG. 4, namely, YES, No, LATER, and MAYBE.

Many other possibilities for use of this kind of spin toy exist. For example, since the spinner 17 immediately assumes a constant rate of descent it can be used as a timer. By suitable variations of dimensions, and particularly of the length of the post 13, the spinner can be made to complete its trip within a predetermined time, which may be anywhere from a very few to a considerable number of seconds. For example, the dimensional relationships illustrated in the drawings may result in approximately 5 seconds time of descent, but longer or shorter times can be provided by changing the shape or weight of the spinner or the diameter or height of the post or the pitch of the grooves in the post.

An example of the use of the spin toy of this invention as a timer would be its use in a game in which a player is required to make a choice or perform an act within a limited short time. Accordingly, the spinner 17 can be placed in its upper position ready for play and when the event occurs which starts the player's time running someone will start the spinner 17 so that the running of the time will be indicated both visibly and audibly. When the spinner reaches the base, the visible gyration stops and its whirring noise likewise stops.

In all its variations this spin toy functions with unparalleled simplicity, reliability, and uniformity.

I claim:

1. A gravity operated spin toy comprising:

a. a base with a horizontal surface, b. a vertical circular post on the base, c. the post having a helical groove of such pitch that several turns occur in a vertical distance equal to the diameter of the post, d. an annular spinner of thin non-magnetic but magnetically attractable material loosely surrounding the post, e. the diameter of the spinner hole being such that it can engage the post in an inclined position at an angle of about 45°, f. a non-magnetic ring smaller than the spinner, fixed on the post near its top, g. a magnet on the post above the fixed ring and projecting beyond the ring sufficiently to attract the spinner in an inclined position, and with a magnetic strength sufficient to hold the spinner with a force permitting easy manual disengagement, whereby a flick of a finger will separate the spinner from the magnet and start the spinner on a gyratory motion down the post.

2. A toy as in claim 1, in which the magnet is annular with a bore of greater diameter than the post, and is symmetrically spaced from the post.

3. A toy as in claim 2 in which the poles of the magnet are at its top and bottom faces.

4. A toy as in claim 3 in which the base bears indicia surrounding the post, and the spinner includes an indicator to designate one of the indicia.

* * * * *